US005425666A

United States Patent [19]

Frank et al.

[11] Patent Number: 5,425,666

[45] Date of Patent: Jun. 20, 1995

[54] ECCENTRIC DISK GRINDER

[75] Inventors: Mario Frank, Buehl; Guenther Berger, Notzingen; Stefan Heess, Filderstadt, all of Germany

[73] Assignee: Robert Bosch GmbH, Stuttgart, Germany

[21] Appl. No.: 120,579

[22] Filed: Sep. 10, 1993

[30] Foreign Application Priority Data

Oct. 7, 1992 [DE] Germany ..... 42 33 727.5

[51] Int. Cl.[6] ..... B24B 23/03

[52] U.S. Cl. ..... 451/344; 451/357

[58] Field of Search ..... 51/170 R, 170 MT, 134.5 R, 51/119, 120, DIG. 7, DIG. 16; 451/344, 357, 294, 270, 271, 906, 915, 359

[56] References Cited

U.S. PATENT DOCUMENTS

| | | | |
|---|---|---|---|
| 3,199,251 | 8/1965 | Enders | 51/170 |
| 4,322,921 | 9/1980 | Maier | 51/170 MT |
| 4,660,329 | 4/1987 | Hutchins | 51/170 MT |
| 4,901,479 | 2/1990 | Helm | 51/170 R |
| 5,170,588 | 12/1992 | Schaal et al. | 51/170 MT |
| 5,251,406 | 10/1993 | Kirn | 51/170 R |
| 5,261,190 | 11/1993 | Berger et al. | 51/170 MT |

*Primary Examiner*—Jack W. Lavinder
*Attorney, Agent, or Firm*—Michael J. Striker

[57] ABSTRACT

An eccentric disk grinder has a housing, a motor accommodated in the housing and having a shaft provided with an eccentric member, a first bearing supporting the shaft, a grinding disk eccentrically, circulatingly and rotatingly driven by the motor through the shaft, and a second bearing in which the grinding disk is rotatable relative to the shaft about an axis of the eccentric member. The second bearing includes at least one first bearing which takes up substantially radial forces and supports at least one of the shaft and the eccentric member at its end facing the grinding disk. The bearings also have at least another second bearing which takes up substantially axial forces and supports at least one of the shaft and the eccentric member at its side facing away from the grinding disk.

20 Claims, 3 Drawing Sheets

ECCENTRIC DISK GRINDER

BACKGROUND OF THE INVENTION

The present invention relates generally to eccentric disk grinders. In particular, it relates to an eccentric disk grinder which has a multi-part housing with a motor which eccentrically drives a grinding disk via a shaft so that the grinding disk is rotatable relative to the shaft about an axis of an eccentric pin or an eccentric shaft.

One such eccentric disk grinder is disclosed for example in the German reference DE-OS 36 25 655. Its grinding disk is driven by a motor. The rotation of the motor is converted via an angular transmission on a shaft carrying an eccentric pin into the working movement which is composed of a rotary movement and a circular movement of the grinding disk. The shaft, supported at two points, carries at its free end a rotatable eccentric pin. The pin is rotatable with an eccentricity "e" relative to the shaft on which two ball bearings are arranged. The eccentric pin is coupled non-rotatably with the grinding disk and circulates together with it with the eccentricity "e" around the axis of the shaft and therefore rotates due to the bearing friction with the shaft.

The bearings between the eccentric shaft and the shaft are subjected to high, non-uniform loading. This leads to intense heat generation and wear, when not unconventionally intensive heat withdrawal is performed, for example by a cooling fan.

The cooling of the bearings in abrasive medium-containing air, typical of a grinding machine, requires especially expensive seals of the bearings which are simpler for ball bearings than for roller bearings. Due to the required good heat withdrawal, metal fans must be utilized which are heavier than synthetic plastic fans and need stronger bearings.

Some driven shafts of hand-held power tools which are vibration-technically simple and have low abrasive-dust loading, for example drilling machines and plunge saws, are supported in radial-axial bearing pairs and the radial bearings are arranged at the side facing the tool. This solution is, however, not transferable to the eccentric disk grinders. The bearing calculations for eccentric disk grinders due to the complicated superimposed movements and the imbalance involve only coarse approximation solutions. The actual bearing forces can be determined only by substantial experiments. Only in this way can the bearing arrangement be determined. Due to the unpredictable bearing computations, until the present time many over-dimensioned axial-radial ball bearings have been utilized, while roller bearings or needle bearings are substantially more price favorable than ball bearings. This makes the known devices significantly more expensive.

SUMMARY OF THE INVENTION

Accordingly, it is an object of the present invention to provide an eccentric disk grinder which avoids the disadvantages of the prior art.

In keeping with these objects and with others which will become apparent hereinafter, one feature of the present invention resides, briefly stated, in an eccentric disk grinder in which the shaft and/or the eccentric shaft at their side facing the grinding disk is/are supported in at least one bearing which takes up substantially radial forces, and at their side facing away from the grinding disk is/are supported in at least one bearing which takes up substantially axial forces.

When the eccentric grinding disk is designed in accordance with the present invention, it has the advantage of substantially reduced heat generation, a resulting reduced wear, reduced weight and vibration and reduced manufacturing costs, since the axial and radial forces are taken up separately and by two different bearings.

In accordance with further features of the present invention, at least one bearing located near the grinding disk can be formed as a needle bearing and at least one bearing located further from the grinding disk can be formed as a ball bearing. The eccentric shaft can be supported in an eccentric opening of the hollow shaft which is open at its two ends. The eccentric shaft, in particular at the side facing away from the grinding disk, can be formed as a roller shaft which rolls on a roller path.

The shaft can support a fan composed of a light material, in particular synthetic plastic material with low heat conductivity. The axis of the motor can extend transversely to the eccentric shaft or parallel to the eccentric shaft. The bearing at the side facing the grinding disk can be sealed by a labyrinth sealing between the hollow shaft and the angular transmission housing, and at the side facing away from the grinding disk can sealed by a co-rotated felt sealing. It is possible that the bearing at the side facing the grinding disk is sealed by a felt ring which is substantially rotatable relative to the eccentric shaft and/or by a radial shaft sealing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
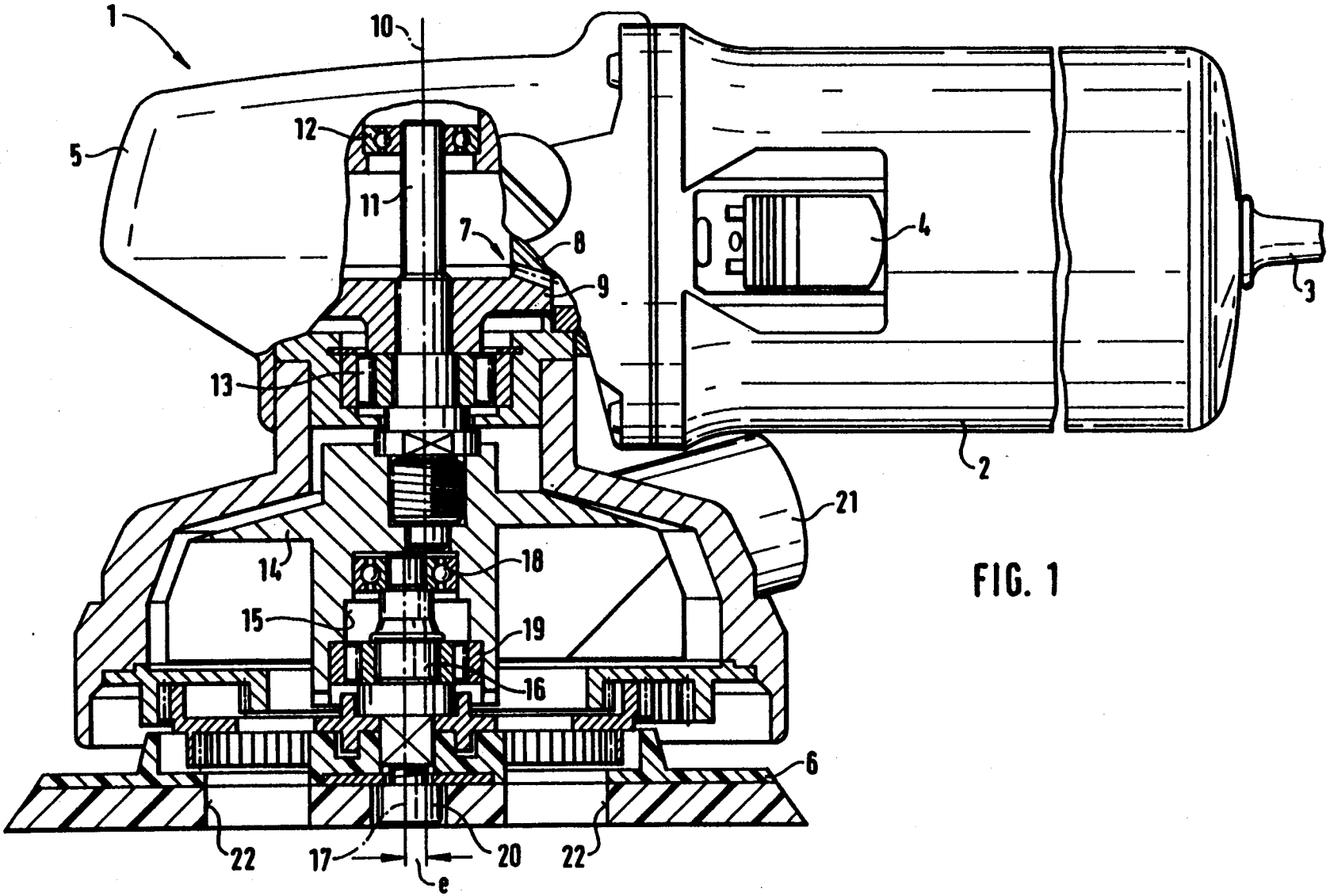
FIG. 1 is a view showing a section of an eccentric disk grinder in accordance with the present invention.

An eccentric disk grinder 1 shown in FIG. 1 has a motor housing 2 with an electrical connecting cable 3 and an on-off switch 4. An angular transmission housing 5 is mounted on the motor housing and accommodates an angular transmission 7 cooperating with a grinding disk 6. The angular transmission 7 includes a small bevel gear 8 arranged on a not-shown motor shaft and transmitting a motor movement to a greater bevel gear 9. The bevel gear 9 concentrically and non-rotatably surrounds a shaft 11 which is rotatable about rotary axis 10. The shaft 11 is supported in first bearing means including bearings 12 and 13 in the angular transmission housing 5 in a region which faces toward the grinding disk and faces away from the grinding disk.

The shaft 11 supports a fan 14 at its lower free end. The fan 14 provides for dust aspiration and bearing cooling and also a mass compensation. It is composed of a light material, in particular synthetic plastic material with low heat conductivity. The fan 14 at its side facing away from the shaft 11 has an opening 15 extending eccentrically to the rotary axis 10. An eccentric member formed as a pin 16 with an axis 17 is inserted in the opening 15. The axis 17 is spaced from and extends parallel to the rotary axis 10 with an eccentricity "e". The eccentric pin 16 is guided concentrically to the axis 17 in second bearing means including an upper axial solid bearing 18 formed as a ball bearing and a lower needle bearing 19 which takes up only radial forces.

The grinding disk 6 is screwed on the eccentric pin 16 via a stud 20. The grinding disk 6 is provided with recesses 22 which are uniformly distributed over its surface. Through the recesses the grinding dust from a workpiece can be aspirated through a tubular pipe 21 by the fan 14 or a not-shown external blower.

The bearings 12 and 18 have an inner ring diameter of at least 5 mm, an outer ring diameter of at least 15 mm, and a bearing width of at least 5 mm. The bearings 13 and 19 have an inner sleeve inner diameter of at least 6 mm, an outer sleeve outer diameter of at least 10 mm, and a bearing width of at least 6 mm. The axial distance between the bearings 12 and 13 amounts to 10–30 mm, while the axial distance between the bearings 18 and 19 amounts to 5–20 mm. These dimensions are obtained by experiments and are considered as especially advantageous.

When the not-shown motor is turned on by the switch 4, the bevel gears 8 and 9 are rotated. The bevel gear 9 rotates together with the shaft 11 around the rotary axis 10. The shaft 11 drives the fan 14 which drives the eccentric pin 16 located in its eccentric opening 15. The eccentric pin 16 circulates around the rotary axis 10 with the eccentricity "e" and rotates due to the friction in the bearings 18 and 19, so that the grinding disk 6 follows this movement.

The arrangement of the bearings 13 and 19 which are formed as needle bearings and take up only the radial forces close to the grinding disk 6, and the arrangement of the ball bearings 12,18 which take up substantially only axial forces far from the grinding disk 6, substantially improve the efficiency of the movement transmission and increase the service life of the eccentric disk grinder 1 when compared with the known devices.

Figure 2:
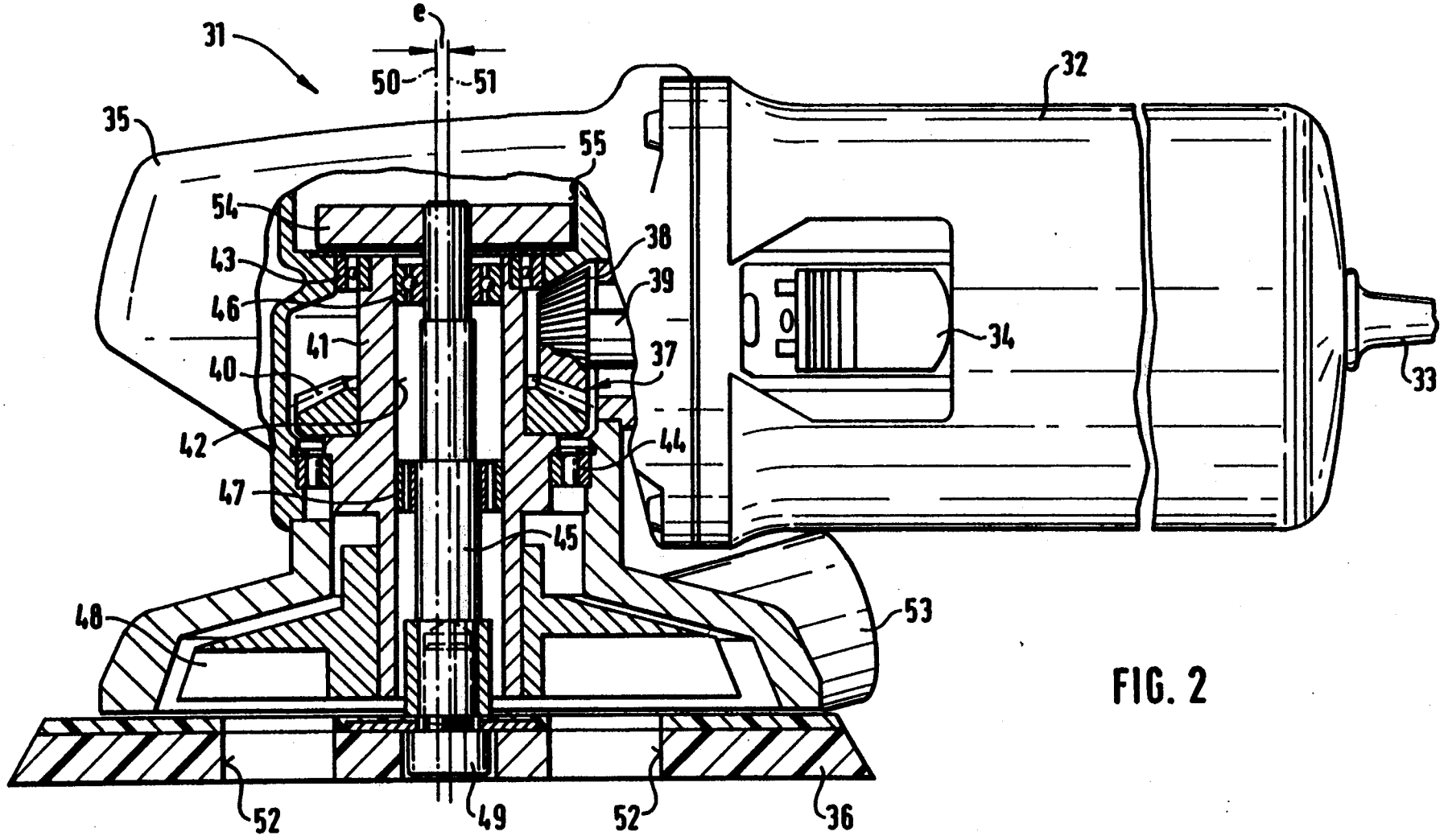
FIG. 2 is a view showing a further embodiment of the eccentric disk grinder of the invention.

In the embodiment shown in FIG. 2 an eccentric disk grinder 31 has a motor housing 32, on which an electric connecting cable 33 and an on-off switch 34 are arranged. An angular transmission housing 35 is mounted on the motor housing 32 and contains an angular transmission 37 cooperating with a grinding disk 36. The angular transmission 37 includes a small bevel gear 38 mounted on a motor shaft 39 and transmitting a motor movement to a-greater bevel gear 40. The greater bevel gear 40 concentrically and non-rotatably surrounds a hollow shaft 41 with an eccentric through-going opening 42.

The hollow shaft 41 at its side facing away from the grinding disk 37 is supported by first bearing means including a ball bearing 43 which takes up substantially axial forces, and at its side located close to the grinding disk is supported by a needle bearing 44 taking up substantially only radial forces, in the angular transmission housing 35. In the eccentric, circular opening 42, an eccentric member formed as a shaft 45 is arranged in second bearing means including a second ball bearing 46 which is located far from the grinding disk and takes up axial forces, and a second needle bearing 46 which is located close to the grinding disk and takes up substantially radial forces. A fan 48.is mounted on the hollow shaft 41 between the grinding disk 36 and the needle bearing 44. It provides bearing cooling, dust aspiration, and also mass or imbalance compensation.

The grinding disk 36 is screwed at the lower end of the eccentric shaft 45 with a stud 49. The hollow shaft 41 has a central axis 50 around which it rotates. The eccentric shaft 45 has a shaft axis 51 which corresponds to the axis of the eccentric opening 42. The axis 50 has a distance "e" from the shaft axis 51 which forms the eccentricity and with which the grinding disk 36 circulates.

The grinding disk 36 has several dust aspirating openings 52. Dust produced between the grinding disk 36 and the workpiece is aspirated through the opening 52 by the fan 48 and transported through a tubular pipe 53. A roller gear 54 is rotatably arranged on the upper free end of the eccentric shaft 45. It can roll over a roller path 55.

The bearings 43,46 have an inner ring diameter of at least 5 mm, an outer ring diameter of at least 15 mm, and a bearing width of at least 5 mm. The bearings 44,47 have an inner sleeve inner diameter of at least 6 mm, an outer sleeve outer diameter of at least 10 mm, and a bearing width of at least 6 mm. The axial distance between the bearings 43 and 44 amounts to 30–70 mm, the axial distance between the bearings 46 and 47 amounts to 20–60 mm. These dimensions are obtained by experiments and are especially advantageous.

When the not-shown motor is turned on by the on-off switch 34, the bevel gears 38,40 are rotated. The bevel gear 40 rotates together with the hollow shaft 41 and the fan 48 about the central axis 50. Therefore the shaft 45 is driven in circulating rotation around the axis 50. The distance between the central axis 50 from the shaft axis 51 determines the magnitude of the eccentricity "e", with which the shaft 45 and thereby the grinding disk 30 are rotated.

Due to the friction in the bearings 46,47, a self-rotation is induced to the shaft 45 about its axis 51. The circular movement and the self-rotation determines the working movement of the grinding disk 36. The self-rotation of the shaft 45 due to the bearing friction is reduced by the rolling of the roller gear 54 over the roller path 55. The arrangement of the radial bearings 44,47 near the grinding disk and the arrangement of the axial bearings 43,46 farther from the grinding disk 36 improve the efficiency of the movement transmission between the motor and the grinding disk 36 and increase, due to the increased friction, the service life and the loading capacity of the eccentric disk grinder of the invention when compared with known eccentric disk grinders.

Figure 3:
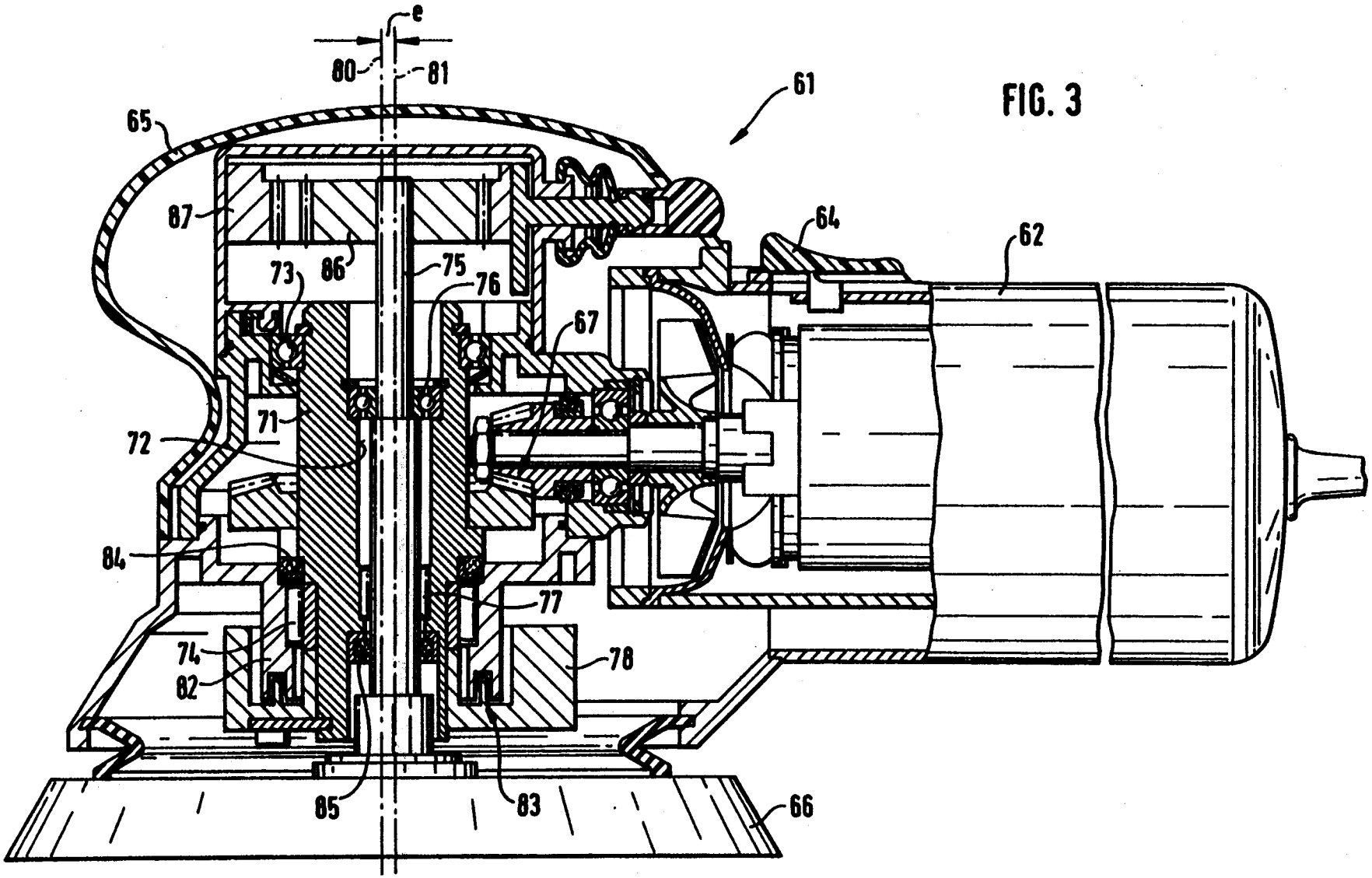
FIG. 3 is a view showing a further modification of the embodiment of FIG. 2.

An eccentric disk grinder 61 in accordance with the embodiment shown in FIG. 3 has some parts which correspond to the parts of the eccentric disk grinder shown in FIG. 2. In particular, it has a motor housing 62 with an on-off switch 64, an angular transmission housing 65, a grinding disk 66, an angular transmission 67, a hollow shaft 71 with an eccentric opening 72 first bearing means including, a ball bearing 73 which takes up substantially axial forces and a needle bearing 74 which takes up substantially only radial forces and is provided with a cover disk 74', an eccentric member formed as a shaft 75 with a second ball bearing 76 which is spaced from the grinding disk and takes up axial forces and a second needle bearing 77 which is located close to the grinding disk and takes up substantially radial forces, a mass compensation member 78, a central axis 80, a shaft axis 81 which corresponds to the axis of the eccentric opening 72, and is arranged at a distance "e" relative to the axis 80, a roller gear 86 and a roller path 87. The bearing 74 is a sealed needle bearing with a not-shown covering sleeve. Moreover, a labyrinth seal 83 is arranged between an end surface 79 of the mass compensating member 78 and the end side of a collar 82 of the angular transmission housing 65° It prevents penetration of dust to the bearing 74 from the side of the grinding disk 66. At the side opposite to the labyrinth seal 83, the gap between the collar 82 and the hollow shaft 71 and thereby the bearing 74 is sealed by a felt ring 84 which co-rotates with the hollow shaft 71 relative to the angular transmission 67 to prevent a lubricant discharge. Moreover, the ring gap between the eccentric shaft 75 and the hollow shaft 71 before the needle bearing 77 at the side facing the grinding disk 66 is sealed by a felt seal 85 which is designed as a radial shaft sealing ring co-rotating with the hollow shaft 71.

The bearings 73 and 76 have an inner ring diameter of at least 5 mm, an outer ring diameter of at least 15 mm, and a bearing width of at least 5 mm. The bearings 74 and 77 have an inner sleeve inner diameter of at least 6 mm, an outer sleeve outer diameter of at least 10 mm, and a bearing width of at least 6 mm. The axial distance between the bearings 73 and 74 amounts to 30–70 mm, and the axial distance between the bearings 76 and 77 amounts to 20–60 mm. These dimensions are obtained from experiments and are especially advantageous.

The operation and functions of the eccentric disk grinder of FIG. 3 corresponds to those of the eccentric disk grinder of FIG. 2.

In a not-shown embodiment of the eccentric disk grinder in accordance with the present invention, the sealing between the hollow shaft and the eccentric shaft is provided by a felt seal arranged non-rotatably on the eccentric shaft, while the hollow shaft is provided with a return feed thread. Thereby the eventually produced dust is withdrawn and discharged. Moreover, in addition to the felt seal, a radial shaft sealing ring is arranged as well.

It will be understood that each of the elements described above, or two or more together, may also find a useful application in other types of constructions differing from the types described above.

While the invention has been illustrated and described as embodied in an eccentric disk grinder, it is not intended to be limited to the details shown, since various modifications and structural changes may be made without departing in any way from the spirit of the present invention.

Without further analysis, the foregoing will so fully reveal the gist of the present invention that others can, by-applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An eccentric disk grinder, comprising a housing; a motor accommodated in the housing and having a shaft provided with an eccentric member; first bearing means rotatably supporting said shaft; a grinding disk eccentrically, circulatingly and rotatingly driven by said motor through said shaft; second bearing means rotatably supporting said eccentric member so that said grinding disk is rotatable relative to said shaft about an axis of said eccentric member; at least one of said bearing means including at least one bearing which takes up substantially radial forces and supports at least one of said shaft and said eccentric member at its end facing said grinding disk, and another bearing which takes up substantially axial forces and supports said at least one of said shaft and said eccentric member at its side facing away from said grinding disk said one bearing being located closer to said grinding disk and formed as a needle bearing, while said another bearing is located farther from said grinding disk and formed as a ball bearing.

2. An eccentric disk grinder as defined in claim 1, wherein said eccentric member is formed as an eccentric pin.

3. An eccentric disk grinder as defined in claim 1, wherein said eccentric member is formed as an eccentric shaft.

4. An eccentric disk grinder as defined in claim 1, wherein said shaft is a hollow shaft which has an eccentric opening and is open at its both ends, said eccentric member being formed as an eccentric shaft supported in said eccentric opening of said hollow shaft.

5. An eccentric disk grinder as defined in claim 4, wherein said eccentric shaft carries a roller gear which rolls over a roller path.

6. An eccentric disk grinder as defined in claim 1, wherein said another bearing has an inner ring diameter of at least 5 mm, an outer ring diameter of at least 15 mm, and a bearing width of at least 5 mm.

7. An eccentric disk grinder as defined in claim 1, wherein said one bearing has an inner sleeve inner diameter of at least 6 mm, an outer sleeve outer diameter of at least 10 mm, and a bearing width of at least 6 mm.

8. An eccentric disk grinder as defined in claim 1, wherein said one and another bearings are spaced from one another by an axial distance of 10–30 mm, another of said bearing means including a further such one bearing and another bearing which are spaced from one another by an axial distance of 5–20 mm.

9. An eccentric disk grinder as defined in claim 1, wherein said one and another bearings are spaced from one another by an axial distance of 30–70 mm, another of said bearing means including a further such one bearing and a further such another bearing which are spaced from one another by an axial distance of 20–60 mm.

10. An eccentric disk grinder as defined in claim 1, wherein said shaft carries a fan.

11. An eccentric disk grinder as defined in claim 10, wherein said fan is arranged so that it provides a mass compensation.

12. An eccentric disk grinder as defined in claim 1, wherein said axis of said motor has an axis which extends transversely to said eccentric member.

13. An eccentric disk grinder as defined in claim 1, wherein said needle bearing is formed as a sealed needle bearing.

14. An eccentric disk grinder as defined in claim 13, wherein said sealed needle bearing is provided with a cover disk.

15. An eccentric disk grinder as defined in claim 1, wherein-another of said bearing means includes a further such one bearing formed as a needle bearing and a further such another bearing formed as a ball bearing; and further comprising a labyrinth seal which seals one of said needle bearing at its side facing said grinding disk; and a felt ring which seals said one of said needle bearings at its side facing away from said grinding disk and co-rotates with said shaft.

16. An eccentric disk grinder as defined in claim 15; and further comprising an angular transmission provided between said shaft and said grinding disk and having an angular transmission housing, said shaft being and a hollow shaft having an eccentric opening in which said eccentric member is supported, said labyrinth seal being located between said hollow shaft and said angular transmission housing.

17. An eccentric disk grinder as defined in claim 15; and further comprising a sealing member which seals another of said needle bearings at a side facing said grinding disk.

18. An eccentric disk grinder as defined in claim 17, wherein said sealing member is formed as a felt ring arranged rotatably relative to said eccentric member.

19. An eccentric disk grinder as defined in claim 17, wherein said sealing member is formed as a radial shaft sealing ring.

20. An eccentric disk grinder, comprising a housing; a motor accommodated in the housing and having a shaft provided with an eccentric member; first bearing means rotatably supporting said shaft; a grinding disk eccentrically, circulatingly and rotatingly driven by said motor through said shaft; second bearing means rotatably supporting said eccentric member so that said grinding disk is rotatable relative to said shaft about an axis of said eccentric member; at least one of said bearing means including at least one bearing which takes up substantially radial forces and supports at least one of said shaft and said eccentric member at its end facing said grinding disk, and another bearing which takes up substantially axial forces and supports said at least one of said shaft and said eccentric member at its side facing away from said grinding disk, said shaft being a hollow shaft which has an eccentric opening and is open at its both ends, said eccentric member being formed as an eccentric shaft supported in said eccentric opening of said hollow shaft and carrying a roller gear which rolls over a roller path, said roller gear being supported on said eccentric shaft at its side facing away from said grinding disk.

* * * * *